US006516140B2

(12) United States Patent
Arnold et al.

(10) Patent No.: US 6,516,140 B2
(45) Date of Patent: Feb. 4, 2003

(54) FURNACE WITH INTEGRAL GRILLE

(75) Inventors: Daniel James Arnold, Wichita, KS (US); Tabraiz Ali Khan, Wichita, KS (US)

(73) Assignee: York International Corporation, York, PA (US)

( * ) Notice: Subject to any disclaimer, the term of this patent is extended or adjusted under 35 U.S.C. 154(b) by 0 days.

(21) Appl. No.: 09/853,603

(22) Filed: May 14, 2001

(65) Prior Publication Data

US 2002/0168183 A1 Nov. 14, 2002

(51) Int. Cl.[7] ..... F24H 3/00

(52) U.S. Cl. ..... 392/360; 392/351; 165/48.1

(58) Field of Search ..... 392/360, 363, 392/351; 62/411, 412; 454/309, 321; 165/59, 65, 122, 48.1, 49, 63, 64; 126/110 R, 110 AA

(56) References Cited

U.S. PATENT DOCUMENTS

| | | | | | |
|---|---|---|---|---|---|
| 1,416,601 | A | * | 5/1922 | Boone | 392/365 |
| 2,882,383 | A | * | 4/1959 | Boyd et al. | 392/360 |
| 2,977,455 | A | * | 3/1961 | Murphy | 392/363 |
| 3,212,288 | A | * | 10/1965 | Herbert | 165/48.1 |
| 3,251,540 | A | * | 5/1966 | Kinsworthy | 165/48.1 |
| 3,261,397 | A | * | 7/1966 | Hay | 165/48.1 |
| 3,575,582 | A | | 4/1971 | Covault | |
| 3,601,116 | A | | 8/1971 | Davis et al. | |
| 3,636,307 | A | * | 1/1972 | Pearce | 392/363 |
| 3,653,431 | A | | 4/1972 | Loveley | |
| 3,680,541 | A | | 8/1972 | Honaker, Jr. | |
| 3,973,101 | A | | 8/1976 | Bosse | |
| 4,072,187 | A | | 2/1978 | Lodge | |
| 4,169,500 | A | | 10/1979 | Braver | |
| 4,337,823 | A | | 7/1982 | DelPercio | |
| D290,996 | S | | 7/1987 | Bingham | |
| 4,739,153 | A | | 4/1988 | Rendel et al. | |
| 5,187,949 | A | | 2/1993 | Jung-II et al. | |
| 5,619,864 | A | | 4/1997 | Reedy | |
| 5,765,544 | A | | 6/1998 | Vigansky, Jr. | |
| 5,992,410 | A | | 11/1999 | Raleigh et al. | |
| 6,021,775 | A | | 2/2000 | Dempsey et al. | |

FOREIGN PATENT DOCUMENTS

| | | | | |
|---|---|---|---|---|
| GB | 948089 | * | 1/1964 | 392/360 |
| JP | 59-147940 | * | 8/1984 | 165/48.1 |

* cited by examiner

*Primary Examiner*—John A. Jeffery
(74) *Attorney, Agent, or Firm*—Brian T. Sattizahn; Jonathan P. Miller; McNees Wallace & Nurick LLC

(57) ABSTRACT

An electric furnace comprising an integral front panel containing a plurality of louvers. The interior of the furnace contains a flow channel to direct air towards the top of the furnace. At least some of the louvers will direct air into the flow channel. The air is then conditioned and delivered back to the home.

14 Claims, 5 Drawing Sheets

FURNACE WITH INTEGRAL GRILLE

BACKGROUND OF THE INVENTION

The present invention relates generally to an electric furnace for use in a manufactured home. In particular, the present invention relates to an electric furnace with an integral front panel.

In site-built residential homes, the furnace typically delivers conditioned air to the home by means of ductwork contained within the walls, floor, basement, and/or attic of the home. The air returns to the furnace by means of a return air ductwork. The furnace then conditions the air and delivers it back to the home. In these systems air filtration generally occurs at some point in the return air ductwork.

In contrast, manufactured homes typically do not contain return air ductwork. Instead, the air returns directly to the furnace. Typically, in homes containing an electric furnace, the furnace is installed in a closet or utility room. The closet or utility room contains a rectangular opening in one of the walls in which a grille is mounted. The return air enters the closet or utility room through this grille where it is drawn downward into the top of the furnace. The grille typically is either completely separate from the furnace or mounted on the top of the furnace. Generally, a filter is located either behind the grille or on the top of the furnace.

The furnace typically contains an A-coil, a blower, and a resistive heater. The blower pulls the air into the furnace through the top of the furnace. The A-coil is generally seated on top of the blower so that the air must pass over the A-coil before it enters the blower. The air is heated or cooled by the A-coil as the air passes over. The air then enters the blower where it is expelled out of the bottom of the furnace and returned to the home. The resistive heater is located underneath the blower. Thus, the air passes over the resistive heater as the blower pushes the air out of the bottom of the furnace.

SUMMARY OF THE INVENTION

The present invention is a manufactured home electric furnace. The furnace includes a main housing forming a first enclosure. The main housing includes a side panel. The furnace also includes a shelf in the first enclosure. The shelf includes a central opening and is spaced from the side panel. A plurality of openings extends across a portion of the side panel to allow for air to flow into the first enclosure. At least some of the openings are positioned below the shelf. The furnace further includes at least one wall to form a second enclosure in combination with the walls of the main housing. In addition, the furnace includes at least one wall to form an airflow channel in combination with adjacent walls of the housing. The airflow channel accepts air from the openings below the shelf and directs the air to the area above the second enclosure. Further, the furnace includes a heating element and an exhaust in the second enclosure. The exhaust returns air from the furnace to the home. Finally, the furnace includes a blower in the second enclosure to promote the flow of air from openings in the side panel to the area above the second enclosure through the central opening of the shelf, over the heating element, and out the exhaust.

Preferably, the distance from the shelf to the side wall is greater than one inch. The furnace also preferably includes an A-coil on the shelf to condition the air above the second enclosure. In addition, the plurality of openings can extend over the majority of the side wall.

The furnace can also include at least one filter and a fastener to maintain the filter directly behind the side panel.

The plurality of openings can also include a plurality of louvers angled to direct the flow of air to the area above the second enclosure.

In another embodiment of the furnace, the furnace includes a main housing comprising a top, a bottom, and at least first, second, third and fourth side walls to form a first enclosure. The furnace also includes a shelf in the first enclosure. The shelf includes a central opening and extends against the first, second, and third side walls and is spaced at a distance from the fourth side wall. A plurality of openings extends across a portion of the side panel. The openings allow for air to flow into the first enclosure. At least some of the openings are positioned below the shelf. The furnace also includes at least one blower wall to form a second enclosure in combination with the shelf, bottom, and first, second, and third side walls. The blower wall also forms an airflow channel in combination with the first, second, and fourth side walls. The air flow channel accepts the flow of air from the openings below the shelf and directs the flow of air to an area above the second enclosure. The furnace further includes a heating element and an exhaust in the second enclosure. The exhaust returns air from the furnace to the home. Finally, the furnace includes a blower in the second enclosure to promote the flow of air from openings in the fourth side wall to the area above the second enclosure, through the central opening of the shelf, over the heating element, and out the exhaust.

Preferably, the distance from the shelf to the fourth side wall is between 15% and 25% of the distance from the fourth side wall to the side wall opposite the fourth side wall. The furnace also preferably includes an A-coil on the shelf to condition the air above the second enclosure. The furnace can also include insulation located directly behind the blower wall.

Another embodiment of the furnace includes a main housing comprising a top, a bottom, and at least first, second, third and fourth side walls to form a first enclosure. The furnace also includes a shelf in the first enclosure. The shelf includes a central opening and extends against the first, second and third side walls and is spaced from the fourth side wall. The distance from the shelf to the fourth side wall is between 15% and 25% of the distance from the fourth side wall to the side wall opposite the fourth side wall. A plurality of louvers are on the fourth side wall. The louvers are angled to direct the flow of air to the area above the second enclosure. At least one of the louvers is positioned below the shelf. The furnace further includes at least one blower wall to form a second enclosure in combination with the shelf, bottom, and first, second, and third side walls. The blower wall also forms an airflow channel in combination with first, second, and fourth side walls. The airflow channel accepts the flow of the air from the louvers below the shelf and directs the flow of air to the area above the second enclosure. The furnace further includes an A-coil on the shelf to condition the air above the second enclosure. In addition, the furnace has a heating element and an exhaust in the second enclosure. The exhaust returns air from the furnace to the home. Finally, the furnace includes a blower in the second enclosure to promote the flow of air from openings in the fourth side wall to the area above the second enclosure, through the central opening of the shelf, over the heating element, and out the exhaust.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate several embodiments of the invention and together with the description, serve to explain the principles of the invention.

DESCRIPTION OF THE EMBODIMENTS

Reference will now be made in detail to the present preferred embodiments of the invention, examples of which are illustrated in the accompanying drawings. Wherever possible, the same reference numbers will be used throughout the drawings to refer to the same or like parts.

Figure 1:
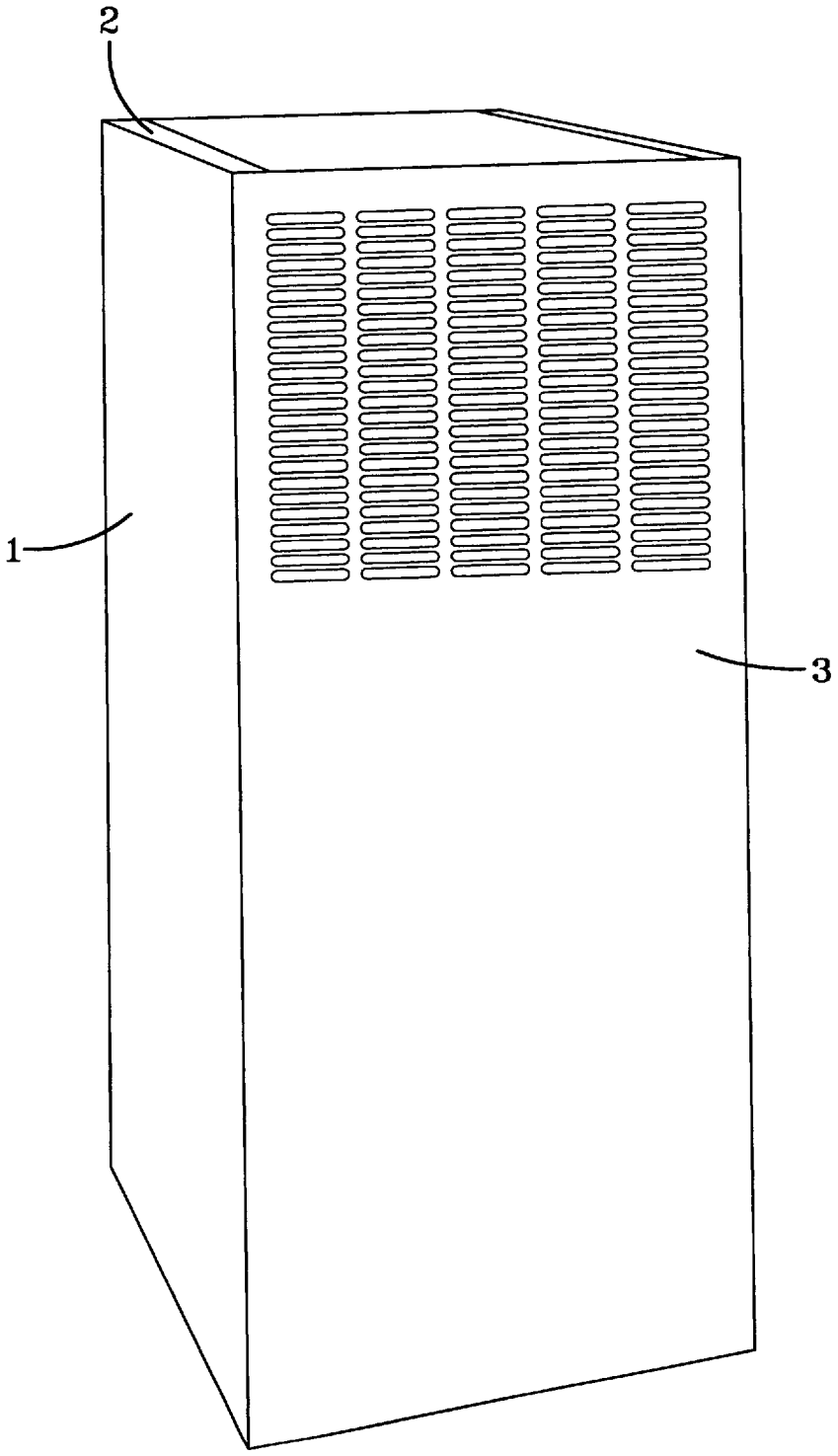
FIG. 1 is a perspective view of a furnace of the present invention.

FIG. 1 shows an electric furnace containing one embodiment of the present invention. The electric furnace 1 is of the type used in manufactured homes. The electric furnace 1 consists of a housing 2 with a side wall 3 for receiving return air from the conditioned space and delivering the return air to the furnace. The working elements of the furnace are enclosed in the housing 2. The housing has a top, bottom, and four side walls that form a first enclosure. The side wall 3 is preferably removable from the rest of the housing. The principles and elements of the present invention can also be incorporated into furnaces having different shapes or exterior walls.

The side wall 3 includes a plurality of openings preferably in the form of louvers. The furnace itself can be any one of a number of conventional electric furnaces used in a manufactured home, as well as future improvements of such furnaces. These furnaces require a side wall to accept air.

Typically, when the furnace 1 is installed in a manufactured home, the installer places the furnace in a closet or utility room in the home. The furnace is installed such that the side wall 3 of the furnace is exposed. During operation, the furnace delivers air to the home by means of ductwork. The air circulates through the home and returns to the furnace through the louvers on the side wall 3. The furnace then conditions the air and returns it to the home.

Figure 2:
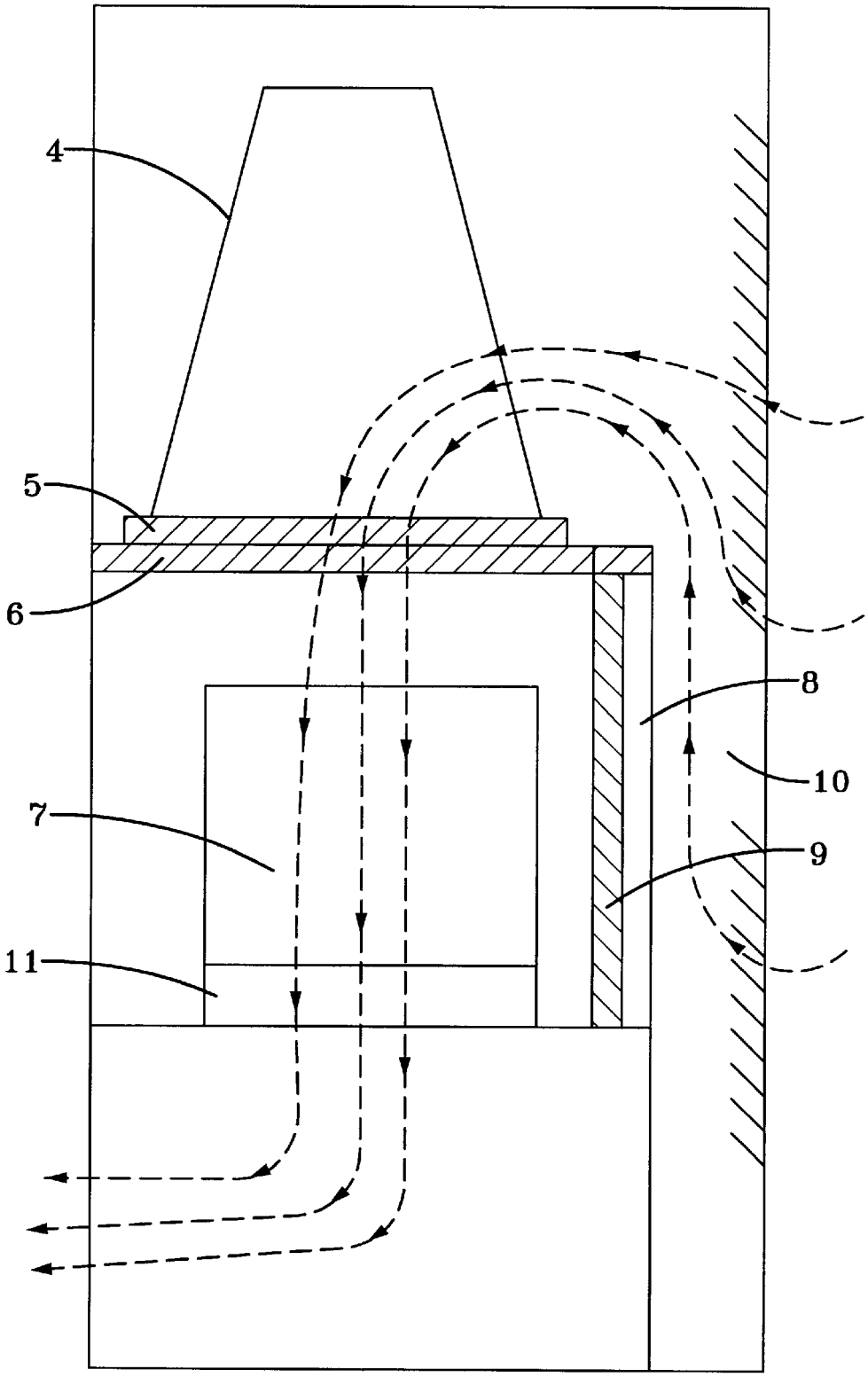
FIG. 2 is an interior view of one embodiment of a furnace of the present invention.
Figure 3:
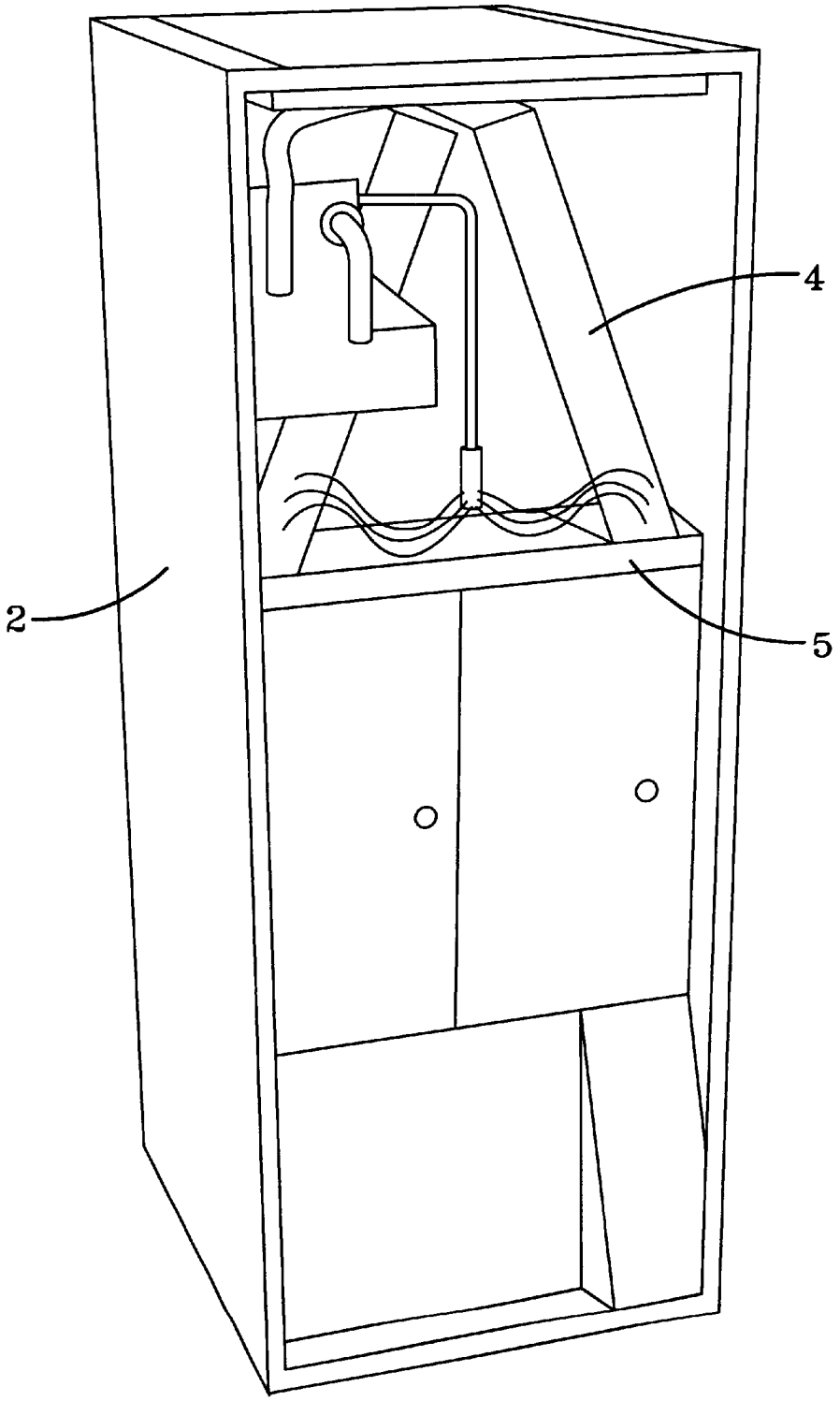
FIG. 3 is a perspective view of one embodiment of a furnace embodying the present invention with the front panel removed.

FIGS. 2 and 3 illustrate the interior of one embodiment of the furnace. The preferred furnace contains an A-coil 4 in the top half of the furnace, so that the furnace can also operate as an air conditioner or a heat pump, as is known in the art. However, the furnace of the present invention can operate without an A-coil and thus provide heating only.

The A-coil 4 sits on top of a drain pan 5, which in turn sits on top of a shelf 6. Preferably, the shelf 6, the interior walls of the housing, and a blower wall 8 form a second enclosure below the shelf. A blower 7 is situated in this second enclosure. The drain pan 5 and the shelf 6 have an opening in their centers to allow the blower 7 to pull air over the A-coil 4 and down through the openings in the drain pan 5 and shelf 6 into the second enclosure. In addition, a heating element 11, such as a resistive heater, is located in the second enclosure. This allows for the air to be heated as the blower forces the air out of the furnace to be returned to the home.

In the furnaces of the prior art, air entered the furnace through the top of the furnace. In the present invention, the air enters the furnace through the side wall as shown in FIG. 2. The side wall includes louvered openings over at least a substantial portion of the wall. These openings accept and direct air into the furnace. In the invention, the number, type, placement, and flow characteristics of the louvers can be varied to provide the desired flow and flow rate for a particular application. For example, in FIGS. 1 and 4, the wall includes louvers in the top half of the wall. In FIGS. 2 and 5, the wall includes louvers in both the top half and the bottom half of the wall. In either embodiment, at least some of the louvers are located below the shelf. The invention, therefore, permits substantially more airflow than that permitted by conventional furnaces where the grille is located near the top of the furnace. This is achieved by the combination of louvers formed in a side wall of the furnace and the incorporation of an additional flow channel in the exterior of the furnace.

As shown in FIG. 2, the furnace includes a flow path in the form of an airflow channel 10 that in this embodiment extends from the bottom of the furnace to the height of the shelf. Air entering into louvers below the shelf flows into this airflow channel and upwards to the top of the furnace. There, the air is mixed with air entering the louvers above the shelf. If the furnace includes an A-coil, the air will mix around the A-coil and be cooled or heated as it is pulled downward by the blower 7. The air is pulled downward, through the opening in the shelf, and into the second enclosure, where it passes over the heating element 11 and then out of the back of the furnace as shown.

To provide the airflow channel, the shelf 6 is spaced away from the side wall 3 having the louvers. At least one wall 8 is installed in the interior of the furnace and extends downward from the shelf to the bottom of the furnace or at least to a point below the lowest louver. Typically, the wall 8 is constructed from sheet metal. The wall 8 connects with the shelf 6 at their intersection. The combination of the wall 8, the sides and bottom walls of the furnace, and the side wall 3, forms the flow channel. In the preferred embodiment, the flow channel has a width of approximately 3½ inches to 4½ inches, a length equal to that of the side wall, and a height of approximately 29 inches.

In one preferred embodiment, insulation 9 is installed on the rear face of the panels 8. This insulation serves a dual purpose. First, the insulation prevents heat transfer between the air on the outside of the blower and the air on the inside of the blower. Second, the insulation dampens the noise created by the blower and thus makes the furnace quieter.

In addition, the louvers in the side wall preferably are designed to create an upward flow of air. This will assist in directing the air to the top of the furnace and the A-coil. By means of example, the louvers could be tilted approximately 20 degrees to direct the incoming air towards the top of the furnace.

Figure 4:
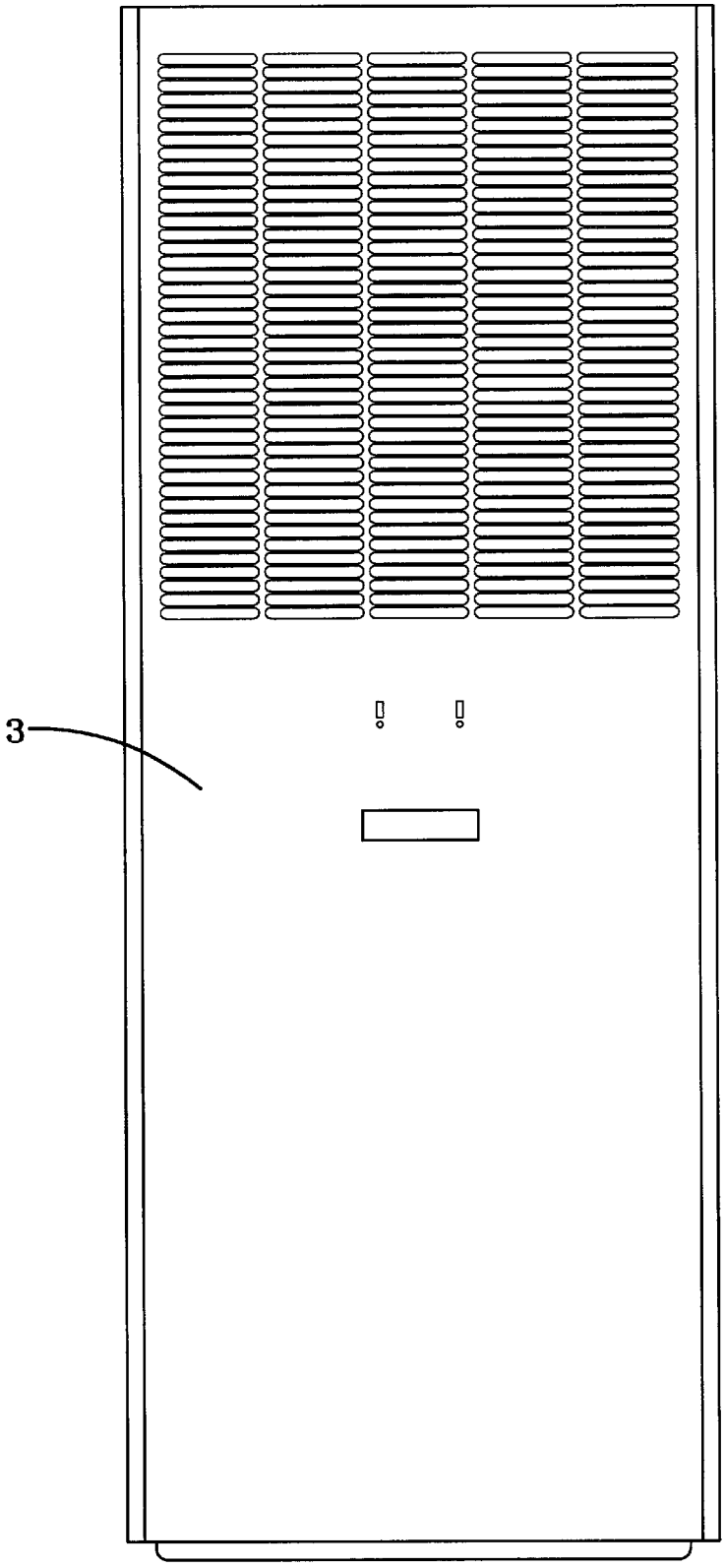
FIG. 4 is a front view one embodiment of a side wall of the invention.
Figure 5:
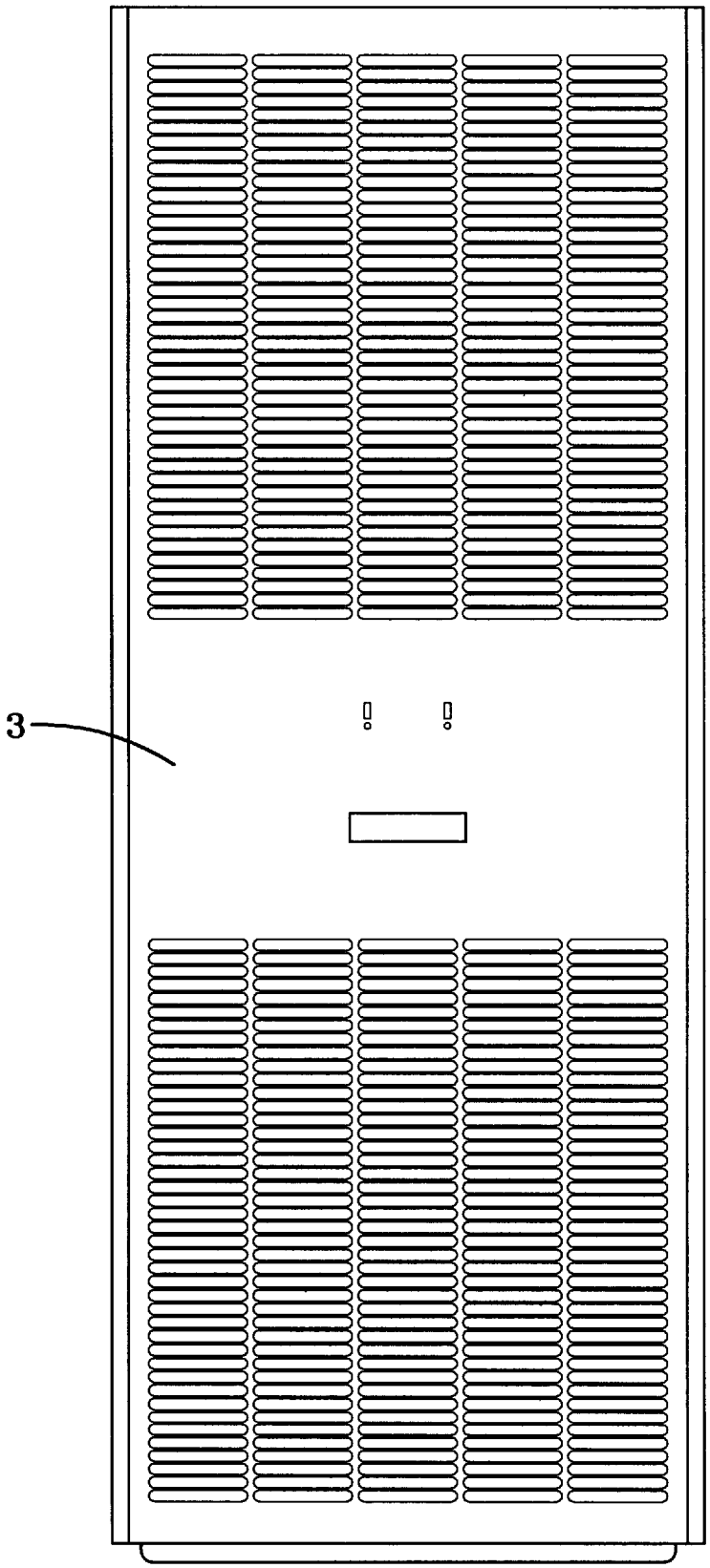
FIG. 5 is a front view of a second embodiment of a side wall of the invention.

FIGS. 4 and 5 show two embodiments of the side wall 3 that can be used with the furnace of the present invention. The side wall 3 is typically constructed of stamped steel.

FIG. 4 shows an embodiment of the side wall 3 typically used in lower capacity systems. In this embodiment, the top portion of the side wall 3 contains slots or louvers to allow for a flow of air. In both embodiments, some of the louvers are positioned below the shelf.

By means of example, in a side wall having exterior dimensions of a height of 50 1/16 inches, a width of 19 5/8 inches and a depth of 1 1/32 inches, the upper louvered portion has a height of 18 21/64 inches and a width of 17 1/4 inches. The side wall has 5 columns of louvers with 42 rows of louvers in each column. Each column is separated by 1/4 of an inch. The louvers are generally trapezoidal shaped and are tilted at a 20 degree angle so as to direct the air upward into the furnace. The louvers are spaced vertically from each other by approximately 1/8 of an inch, thereby providing an airflow slot with a height of 0.318 inches and a width of 3 1/4 inches. This wall provides approximately 217 square inches of open area for airflow. As shown, the air flows through the louvers into the airflow channel 10 between the panel 8 and the side wall 3 and then upward into the area above the shelf.

FIG. 5 shows an embodiment of the side wall 3 typically used in higher capacity systems. As shown in FIG. 5, the wall has a top and bottom portion containing slots or louvers to allow for a flow of air through the wall. The dimensions of each louvered portion are similar to that of the louvered portion of the lower capacity wall described in FIG. 4. Therefore, this wall would provide approximately 434 square inches of open area for airflow. In this embodiment, all of the air flowing through the louvers in the bottom portion flows into the airflow channel 10 and upward to the top of the furnace.

The walls in FIGS. 4 and 5 preferably include a system to hold one or more filters behind the side wall to filter the air as it enters the furnace. A variety of methods can be used to hold filters behind the side walls. For example, formed wire rods, brackets and clips can all be used to retain filters behind the side wall.

Both embodiments have fastening means to connect the side wall to the casing. In the preferred embodiment, the side walls have a flange on their bottom edge. This flange is placed behind a flange on the casing. The top edge of the side wall contains a flange, which is engaged by a door angle in the top of the casing. The combination of the flanges and door angle will secure the side wall in place. It should be understood that other fastening means could be used.

In summary, the present invention includes a main housing that forms a first enclosure for housing the working components of the furnace, such as the blower and heating element. The housing has a louvered side wall to accept air. The furnace includes a shelf, with a central opening. The shelf can hold an A-coil, if an A-coil is to be added to the furnace. The shelf preferably extends outward against all of the inner walls of the furnace, except the wall with the louvers to accept return air. At least some of the louvers extend below the shelf.

To allow return air to flow from these louvers into the enclosed chamber above the shelf, the invention includes an airflow channel that is positioned immediately behind the louvers and that extends upwardly to the chamber above the shelf. This airflow channel can be formed by any number of different surfaces as long as the channel extends from below the lowest louver upward to the chamber above the shelf.

The blower and the heating element are located in a second enclosure below the shelf and preferably formed by the shelf, the inner walls of the housing, and a blower wall spaced from one wall of the housing Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A manufactured home electric furnace comprising:

a main housing comprising a plurality of walls, the plurality of walls forming a first enclosure, the plurality of walls including a side wall having a plurality of openings to permit air to flow into the first enclosure;

a shelf disposed in the first enclosure a distance from the side wall having a plurality of openings, the shelf including a central opening, and at least one opening of the plurality of openings in the side wall being disposed below the shelf;

a wall disposed in the main housing opposite the side wall, the wall being configured and disposed to form a second enclosure in combination with the shelf and at least three walls of the plurality of walls, and the wall being configured and disposed to form an airflow channel in combination with the side wall and at least two walls of the plurality of walls, the airflow channel being configured to accept air from the at least one opening below the shelf and to direct air to an area above the second enclosure;

a heating element in the second enclosure;

an exhaust in the second enclosure to return air from the furnace; and a blower in the second enclosure to promote the flow of air from openings in the side wall to the area above the second enclosure through the central opening of the shelf, over the heating element, and out the exhaust.

2. The electric furnace of claim 1, where the distance from the shelf to the side wall is greater than one inch.

3. The electric furnace of claim 1, further comprising an A-coil on the shelf to condition the air above the second enclosure.

4. The electric furnace of claim 1, wherein the plurality of openings extends over the majority of the side wall.

5. The furnace of claim 1, further comprising at least one filter and a fastener to maintain the filter directly behind the side panel.

6. The furnace of claim 1, wherein the plurality of openings includes a plurality of louvers angled to direct the flow of air to the area above the second enclosure.

7. A manufactured home electric furnace comprising:

a main housing including a top, a bottom, and at least first, second, third and fourth side walls to form a first enclosure;

a shelf in the first enclosure, said shelf including a central opening and extending against the first, second, and third side walls and spaced at a distance from the fourth side wall;

a plurality of openings extending across a portion of the side panel, to allow for air to flow into the first enclosure, at least some of the openings being positioned below said shelf;

at least one blower wall to form a second enclosure in combination with the shelf, bottom, and first, second, and third side walls, and to form an airflow channel in combination with the first, second, and fourth side walls to accept the flow of air from the openings below the shelf and to direct the flow of air to an area above the second enclosure;

a heating element in the second enclosure;

an exhaust in the second enclosure to return air from the furnace to the home; and a blower in the second enclosure to promote the flow of air from openings in the fourth side wall to the area above the second enclosure, through the central opening of the shelf, over the heating element, and out the exhaust.

8. The electric furnace of claim 7, where the distance from the shelf to the fourth side wall is between 15% and 25% of the distance from the fourth side wall to the side wall opposite the fourth side wall.

9. The electric furnace of claim 7, further comprising an A-coil on the shelf to condition the air above the second enclosure.

10. The electric furnace of claim 7, wherein the plurality of openings extends over the majority of the fourth side wall.

11. The furnace of claim 7, further comprising at least one filter and a fastener to maintain the filter directly behind the fourth side wall.

12. The furnace of claim 7, wherein the plurality of opening includes a plurality of louvers angled to direct the flow of air to the area above the second enclosure.

13. The furnace of claim 7, further comprising insulation located directly behind the blower wall.

14. A manufactured home electric furnace comprising:

a main housing comprising a top, a bottom, and at least first, second, third and fourth side walls to form a first enclosure;

a shelf in the first enclosure, said shelf including a central opening and extending against the first, second and third side walls and spaced from the fourth side wall, the distance from the shelf to the fourth side wall being between 15% and 25% of the distance from the fourth side wall to the side wall opposite the fourth side wall;

a plurality of louvers on the fourth side wall, the louvers being angled to direct the flow of air to the area above the second enclosure, at least one of the louvers being positioned below said shelf;

at least one blower wall to form a second enclosure in combination with the shelf, bottom, and first, second, and third side walls, and to form an airflow channel in combination with first, second, and fourth side walls to accept the flow of the air from the louvers below the shelf and to direct the flow of air to the area above the second enclosure;

an A-coil on the shelf to condition the air above the second enclosure;

a heating element in the second enclosure;

an exhaust in the second enclosure to return air from the furnace to the home; and a blower in the second enclosure to promote the flow of air from openings in the fourth side wall to the area above the second enclosure, through the central opening of the shelf, over the heating element, and out the exhaust.

* * * * *